US005946957A

United States Patent [19]

Yamamoto et al.

[11] Patent Number: 5,946,957

[45] Date of Patent: Sep. 7, 1999

[54] KEYHOLE SHUTTER STRUCTURE

[75] Inventors: Takao Yamamoto; Shinji Goto, both of Saitama, Japan

[73] Assignee: Honda Giken Kogyo Kabushiki Kaisha, Tokyo, Japan

[21] Appl. No.: 09/201,787

[22] Filed: Dec. 1, 1998

[30] Foreign Application Priority Data

Dec. 1, 1997 [JP] Japan ..... 9-330614

[51] Int. Cl.[6] ..... E05B 13/00

[52] U.S. Cl. ..... 70/423; 70/427; 70/455

[58] Field of Search ..... 70/423–428, 455, 70/440, 54–56, DIG. 43, DIG. 56

[56] References Cited

U.S. PATENT DOCUMENTS

| | | | |
|---|---|---|---|
| 1,110,963 | 9/1914 | Robinson | 70/455 |
| 2,491,337 | 12/1949 | Segal | 70/455 |
| 3,142,168 | 7/1964 | Wellekens | 70/455 |
| 3,882,703 | 5/1975 | Hermann | 70/455 X |

FOREIGN PATENT DOCUMENTS

| | | | |
|---|---|---|---|
| 1507261 | 11/1967 | France | 70/455 |
| 1678091 | 12/1971 | Germany | 70/455 |
| 554326 | 1/1957 | Italy | 70/455 |
| 606252 | 7/1960 | Italy | 70/455 |
| 606253 | 7/1960 | Italy | 70/455 |
| 55-128847 | 9/1980 | Japan . | |
| 2075111 | 11/1981 | United Kingdom | 70/423 |

*Primary Examiner*—Lloyd A. Gall

*Attorney, Agent, or Firm*—Birch, Stewart, Kolasch & Birch, LLP

[57] ABSTRACT

A keyhole-shutter structure includes a cylindrical protector block. An upper portion of the protector block includes an approximately square housing portion. A shutter plate is fitted in the housing portion. A cap is placed on the protector block. The bottom of the housing portion has right and left receiving planes for receiving the shutter plate, and a recess formed between the right and left receiving planes in such a manner as to be curved downwardly. Since a recess is provided between right and left receiving planes for receiving a shutter plate, even if the shutter plate is somewhat deformed, the deformed portion interferes to a lesser extent with the recess. Accordingly, a key can be easily inserted into a keyhole even if the shutter plate is somewhat deformed.

14 Claims, 6 Drawing Sheets

KEYHOLE SHUTTER STRUCTURE

BACKGROUND OF THE INVENTION

1. Field of the Invention

The present invention relates to a keyhole for a main switch of a motorcycle.

2. Description of Related Art

Some keyholes for main switches for motorcycles are of a type in which a shutter plate is mounted for preventing permeation of dust and/or rainwater into the keyhole. Such a keyhole-shutter structure has been disclosed, for example in Japanese Utility Model Laid-open No. Sho 55-128847 entitled "Waterproof Structure for Cylinder Lock." As shown in FIG. 2 of this document, the keyhole-shutter structure is intended to bias a waterproof cover 6, which is mounted in a housing groove 1*b* of an inner cylinder 1, by a spring 7 to block a keyhole.

A shutter structure, substantially the same as the above structure, will be described in detail with reference to FIGS. 4 to 6(*a*)–6(*c*).

FIG. 4 is a perspective view of a front portion of a motorcycle. Referring to FIG. 4, there is shown a motorcycle 100 in which a fuel tank 101 and an engine 102 are provided on the central portion of a body frame (not shown). A front fork 104 is steerably mounted on a steering head 103 on the front side. A front wheel 105 is mounted on the lower ends of the front fork 104 and a handlebar 106 is mounted to the upper ends of the front fork 104. Two grips 107 are provided at the both ends of the handlebar 106. Two meters 108 and a main switch 109 are provided at the central portion of the handlebar 106. A clutch lever 111 and an exhaust pipe 112 are mounted on the motorcycle 100.

FIG. 5 is an exploded perspective view of a related art keyhole-shutter structure.

A keyhole-shutter structure 115 for mounting at the entrance end of a main switch 109 (see FIG. 4) includes a cylindrical protector block 120. In the upper portion of the protector block 120 is formed an approximately square recess 121. The bottom of the recess 121 is taken as a receiving plane 122, and a shutter plate 123 is fitted in the recess 121 in such a manner as to be slidable on the receiving plate 122. A cap 124 is positioned on the protector block 120. A compression spring 125 is provided for pushing the shutter plate 123 in the direction in which the shutter plate 123 is closed. Keyholes 126, 127 are positioned adjacent to the shutter plate 123 and in the cap 124, respectively. Locking claws 128 are mounted on the cap 124. A notch 129 is formed in the shutter plate 123.

FIGS. 6(*a*) to 6(*c*) are views showing the function and a problem of the related art keyhole-shutter structure.

A state in which the shutter plate 123 is closed is shown in FIG. 6(*a*). With the key not inserted in the keyhole, the shutter plate 123 is disposed to the left and is closed by a pushing force of the compression spring 125 to block the keyhole 126. In this state, there is no fear of permeation of dust and/or rainwater into the keyhole 126.

The key (not shown), when inserted from the top downwardly in the keyhole, pushes the notch 129. This allows the shutter plate 123 to move in the opening direction.

FIG. 6(*b*) shows a state in which the shutter plate 123 is opened.

When the key 130 is pulled upwardly, the shutter plate 123 is returned to the original state shown by FIG. 6(*a*).

The problem of the related art keyhole-shutter structure will be described with reference to FIG. 6(*c*). For example, the following problem may be encountered in parking the motorcycle having the related art keyhole-shutter structure. When the central portion of the shutter plate 123 is erroneously pushed at a pressure more than a specific value by a projection such as a different key 131, there is a possibility that the shutter plate 123 is not smoothly opened and is plastically deformed in the axial direction of the keyhole. In this case, if the deformed amount yl of the shutter plate 123 becomes larger, the shutter plate 123 may interfere with the receiving plane 122, thereby making the sliding movement of the shutter plate 123 difficult. Thereafter, it is difficult to insert the key in the keyhole, which degrades the operating feeling upon the release of a handle lock or upon the starting of the engine.

SUMMARY AND OBJECTS OF THE INVENTION

An object of the present invention is to provide a keyhole-shutter structure capable of sufficiently preventing occurrence of the above-described problem.

To achieve the above object, according to the present invention, there is provided a keyhole-shutter structure of a type in which a shutter plate biased to block the entrance of a keyhole is slid in the direction perpendicular to the axial line of the keyhole by means of the leading end of a key for allowing insertion of the key into the keyhole, the structure including a protector block for mounting the shutter plate therein, wherein the protector block includes: right and left receiving planes for receiving both ends of a bottom surface portion of the shutter plate; and a recess formed between the right and left receiving planes in such a manner as to be curved in the direction away from the shutter plate.

In the present invention, the protector block includes the right and left receiving planes for receiving both ends of a bottom surface portion of the shutter plate; and a recess formed between the right and left receiving planes in such a manner as to be curved in the direction away from the shutter plate, and accordingly, even if the shutter plate is somewhat deformed in the axial direction of the keyhole, the deformed portion of the shutter plate interferes to a lesser extent with the recess. As a result, the key can be easily inserted into the keyhole even if the shutter plate is somewhat deformed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
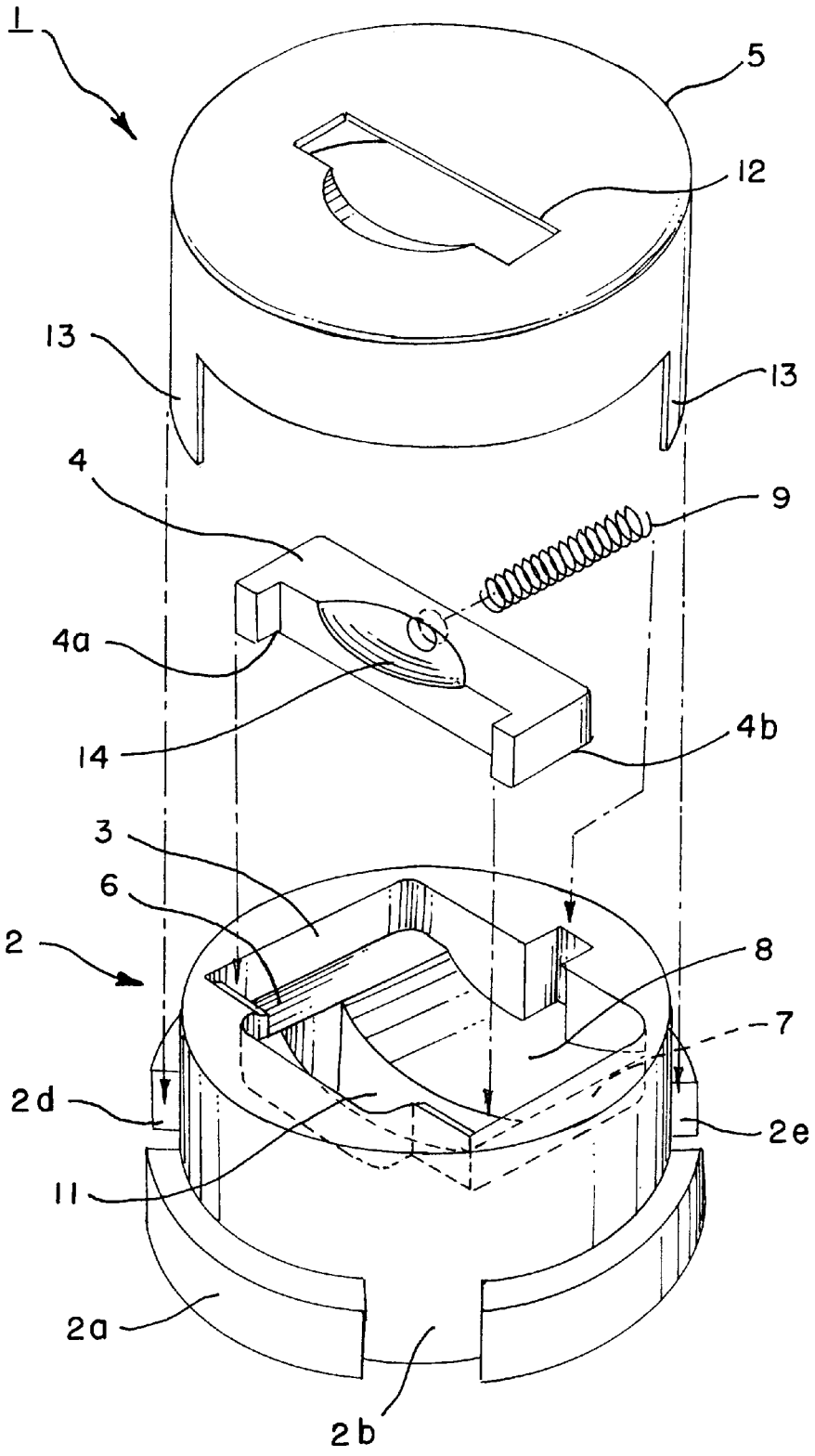
FIG. 1 is an exploded perspective view of a keyhole-shutter structure of the present invention.

The best mode for carrying out the present invention will be described with reference to the accompanying drawings. It should be noted that the drawings should be viewed in the direction of reference numerals.

FIG. 1 is an exploded perspective view of a keyhole shutter structure of the present invention. A keyhole-shutter structure 1 includes a cylindrical protector block 2. In the upper portion of the protector block 2 is formed an approximately square housing portion 3. A shutter plate 4 is fitted in the housing portion 3. A cap 5 is positioned on the protector block 2. The bottom of the housing portion 3 has a right receiving plane 7 and a left receiving plane 6 for receiving the shutter plate 4, and a recess 8 formed between the right and left receiving planes 7 and 6 in such a manner as to be curved downwardly. A compression spring 9 is provided for pushing the shutter plate 4 in the direction in which the shutter plate is closed. Keyholes 11 and 12 are provided within the protector block 2 and in the cap 5, respectively. Locking claws 13 are mounted on the cap 5. A notch 14 is formed on the shutter plate 4.

The protector block 2 has, at its lower portion, a flange 2*a* having a diameter larger than that of the upper portion of the protector block 2. In the flange 2*a* are provided two fitting portions 2*b* (one disposed at the back of the drawing is not viewed) and two fitting portions 2*d* and 2*e*. The fitting portions 2*b*, 2*d* and 2*e* are mounted on the upper portion of a main switch body (not shown). In addition, the fitting portions 2*d* and 2*e* serve as locking portions for locking the locking claws 13 of the cap 5.

The shutter plate 4 is thick enough to exhibit a bending rigidity sufficiently withstanding a load applied from the top downwardly.

The keyhole-shutter structure of the present invention is assembled in the following procedure. First, the shutter plate 4 to which the compression spring 9 is mounted is placed in the protector block 2 in such a manner that both end portions 4*b* and 4*a* of the shutter plate 4 are in contact with the right and left receiving planes 7 and 6 of the protector block 2, respectively. The cap 5 is positioned on the protector block 2. The locking claws 13 are inserted into the associated fitting portions 2*d* and 2*e* and the leading ends of the locking claws 13 are bent onto the bottom of the protector block 2, to thus fix the cap 5 on the protector block 2.

The function of the above-described keyhole-shutter structure will be described below.

Figure 2A:
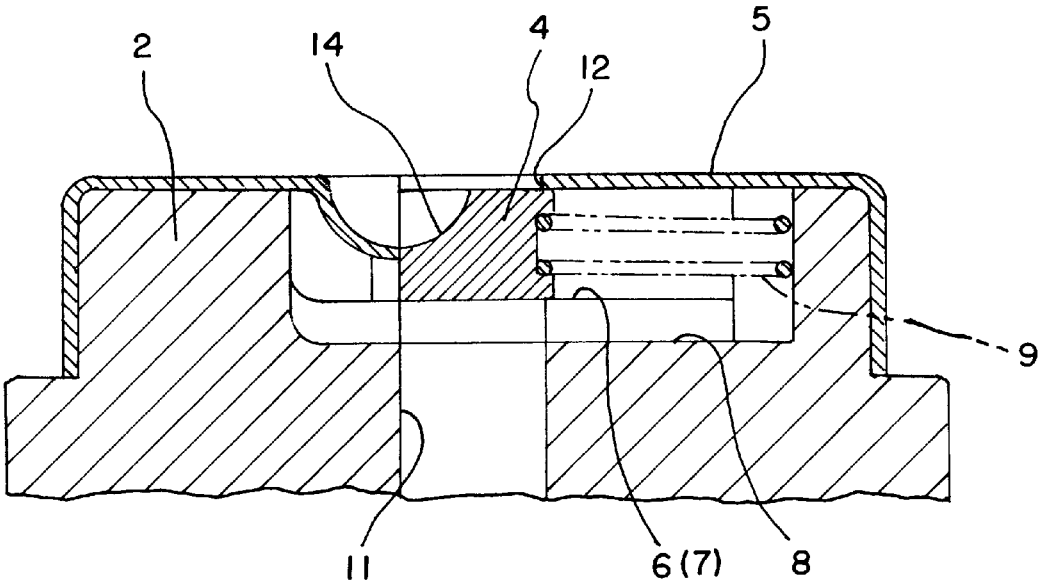
FIGS. 2(*a*) and 2(*b*) are views showing a first function of the keyhole-shutter structure of the present invention.
Figure 2B:
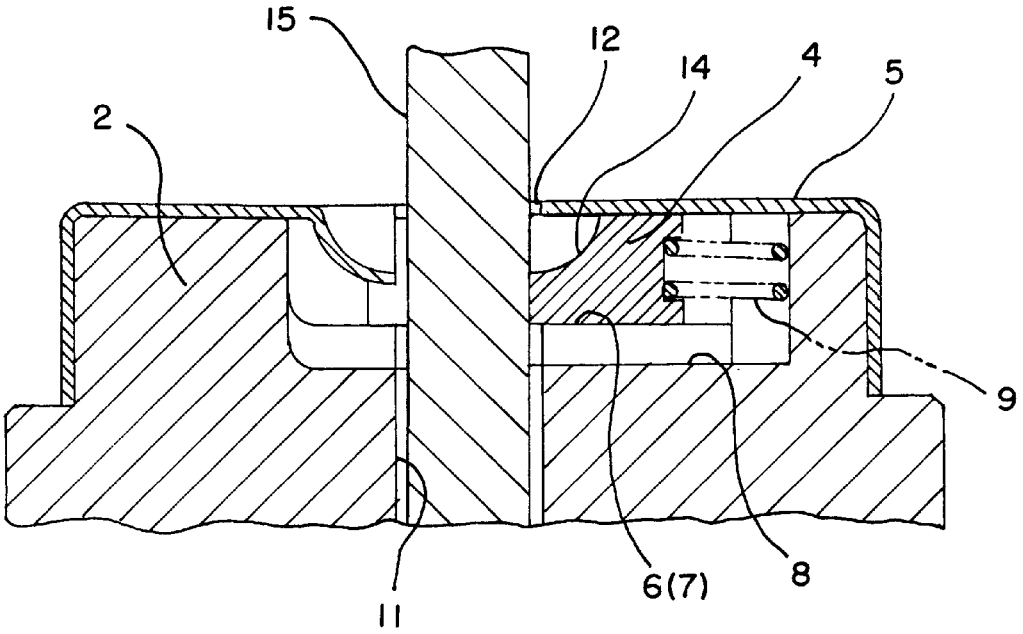

FIGS. 2(*a*) and 2(*b*) are views showing a first function of the keyhole-shutter structure of the present invention.

A state in which the shutter plate 4 is closed is shown in FIG. 2(*a*). With the key not inserted into the keyhole, the shutter plate 4 is left closed by a pushing force of the compression spring 9 to block the keyhole 11. In this state, there is no fear of permeation of dust and/or rainwater into the keyhole 11.

The key (not shown), when inserted from the top downwardly into the keyhole 11, pushes the notch 14. This allows the shutter plate 4 to move in the opening direction.

FIG. 2(*b*) shows a state in which the shutter plate 4 is opened.

When the key 15 is pulled upwardly, the shutter plate 4 is returned to the original state shown by FIG. 2(*a*).

Figure 3A:
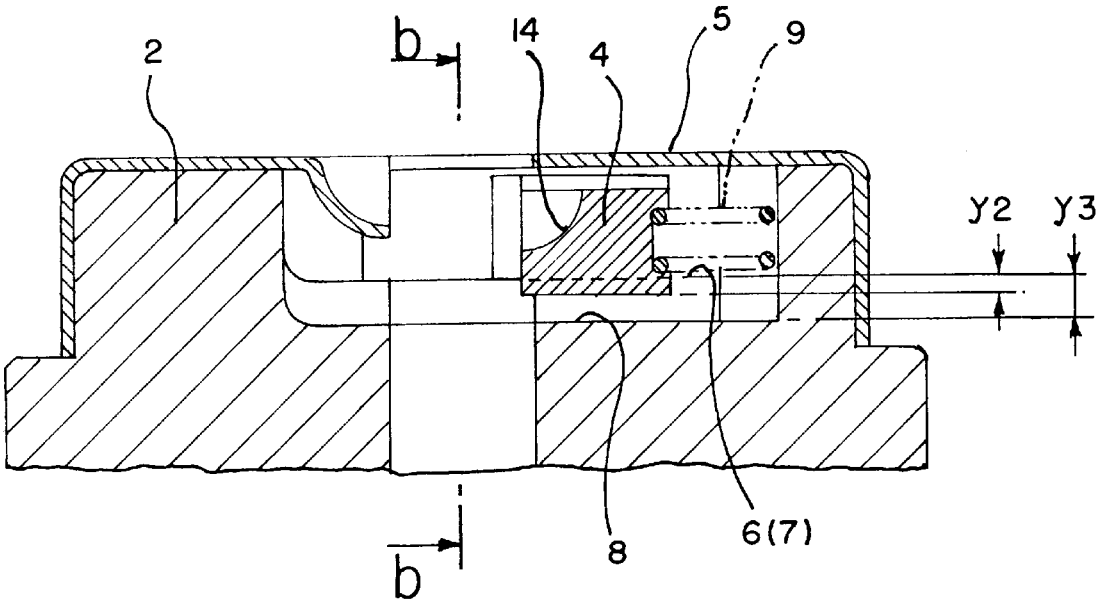
FIGS. 3(*a*) and 3(*b*) are views showing a second function of the keyhole-shutter structure of the present invention.
Figure 3B:
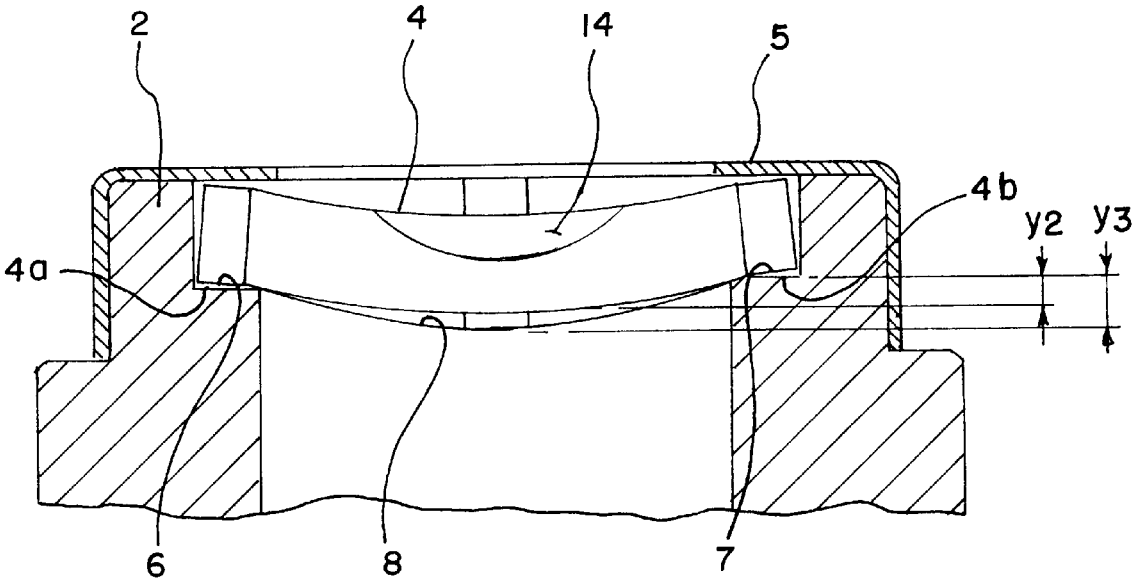
Figure 4:
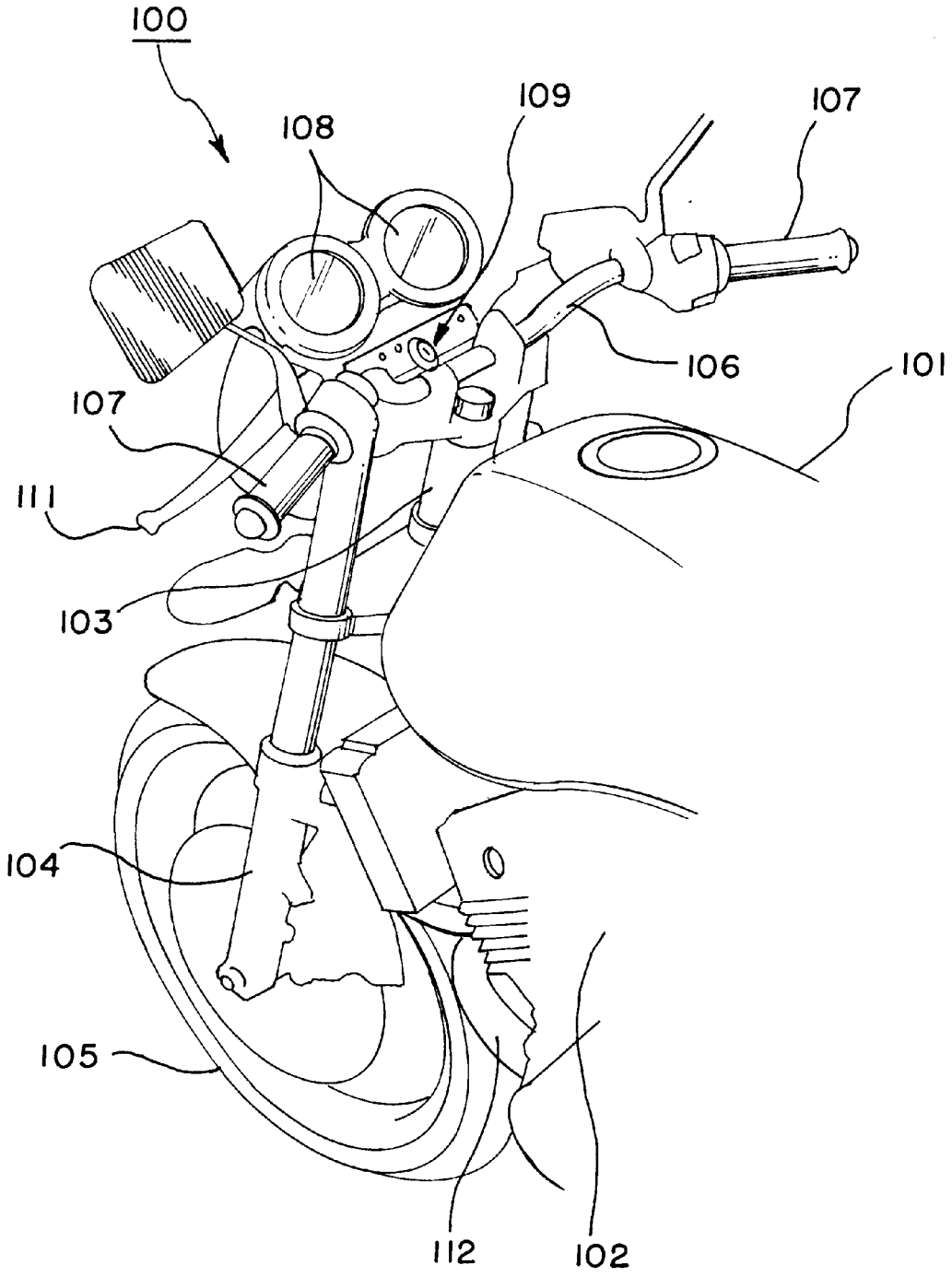
FIG. 4 PRIOR ART
FIG. 4 is a perspective view of a front portion of a motorcycle.
Figure 5:
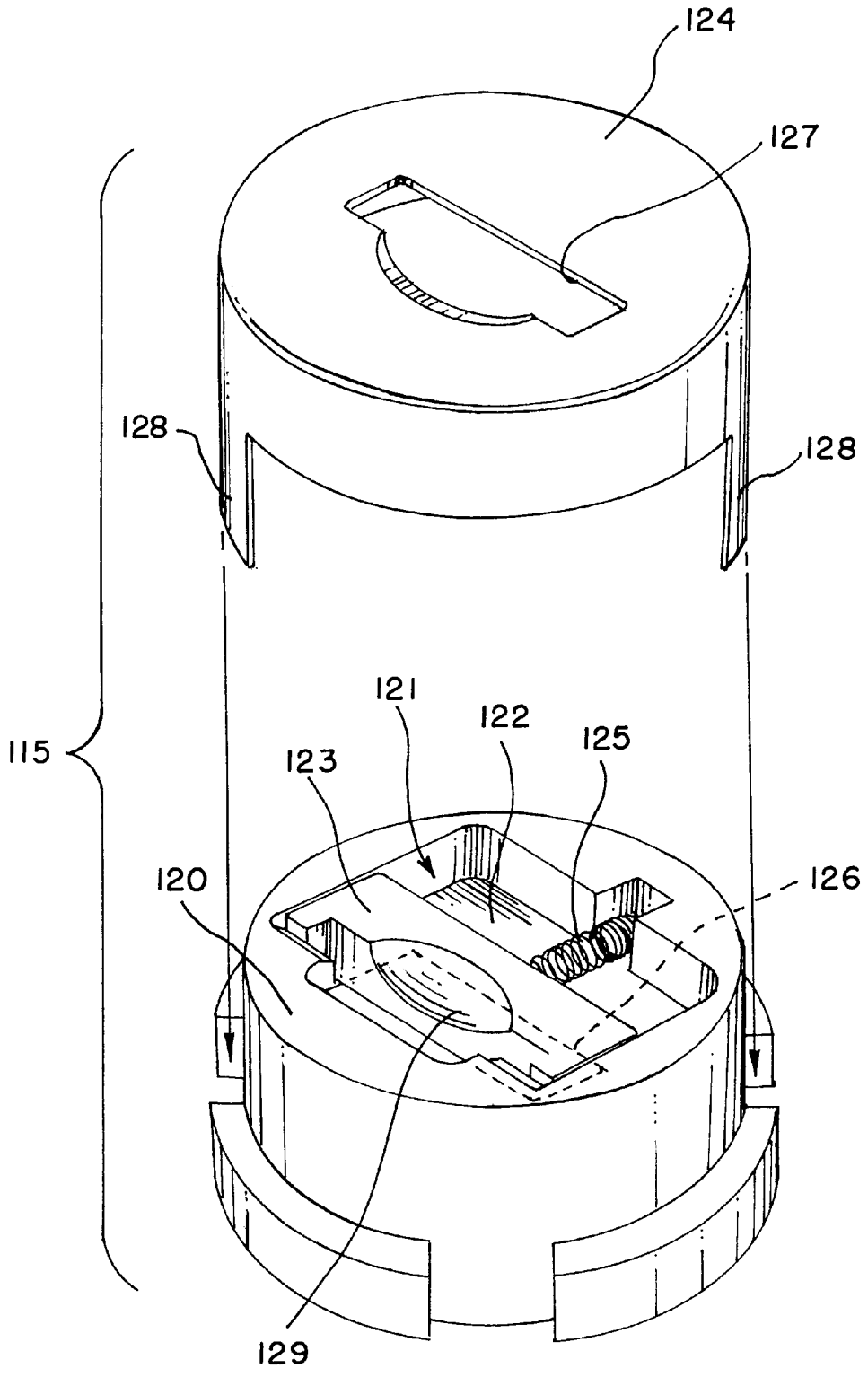
FIG. 5 PRIOR ART
FIG. 5 is an exploded perspective view of a related art keyhole-shutter structure.
Figure 6A:
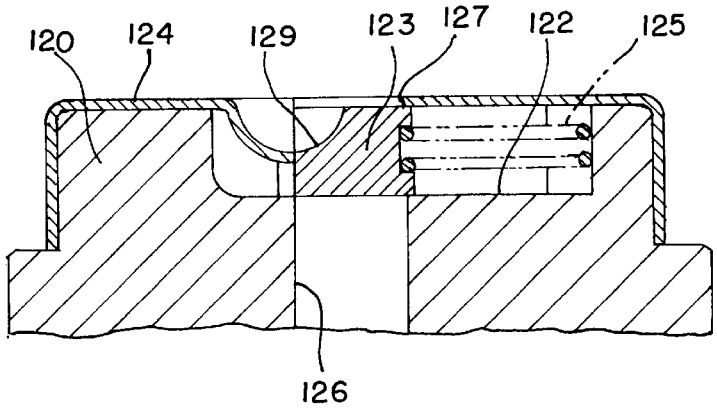
FIG. 6(a) PRIOR ART
FIGS. 6(*a*), 6(*b*) and 6(*c*) are views showing a function and a problem of the related art keyhole-shutter structure.
Figure 6B:
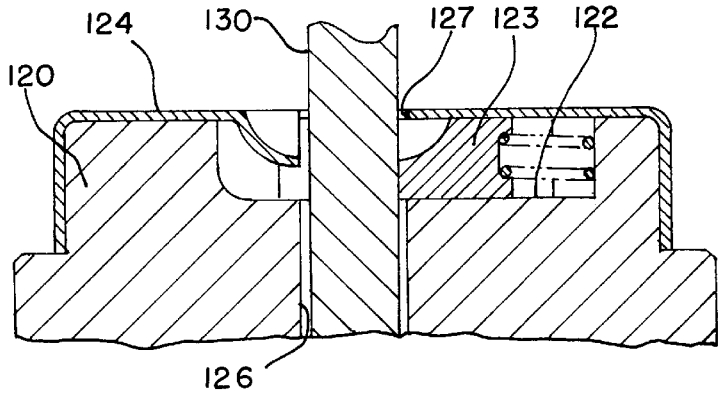
FIG. 6(b) PRIOR ART
Figure 6C:
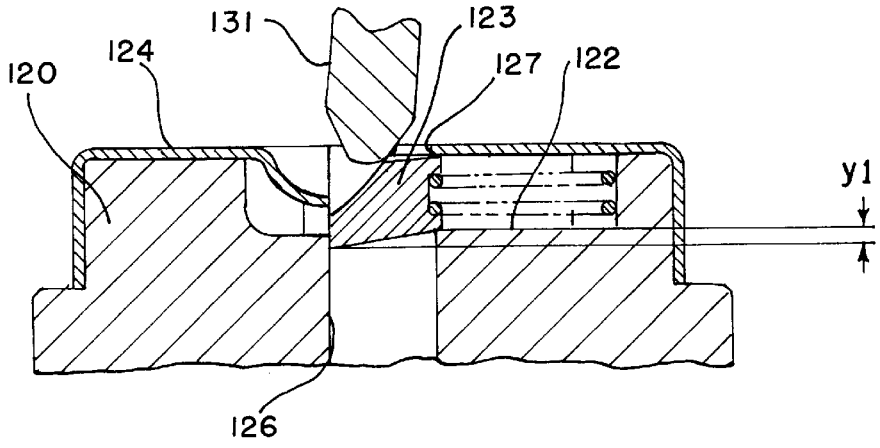
FIG. 6(c) PRIOR ART

FIGS. 3(*a*) and 3(*b*) are views showing a second function of the keyhole-shutter structure of the present invention.

It is assumed that the shutter plate 4 is curved downwardly by a force applied from the top downwardly as shown in FIG. 3(*b*) showing the cross-section taken on line b—b of FIG. 3(*a*). In this case, it is also assumed that since the shutter plate 4 has a sufficiently large bending rigidity, a deflection y2 of the shutter plate 4 is smaller than a depth y3 of the recess 8.

In the above state, the end portions 4*b* and 4*a* of the bottom of the shutter plate 4 are placed on the right and left receiving planes 7 and 6 respectively, with the remaining portion of the bottom between the end portions 4*b* and 4*a* being floated from the recess 8. As a result, the shutter plate 4 is movable in the rearward direction of the drawing. In FIG. 3(*a*), when the key (not shown) is inserted into the keyhole, the shutter plate 4 is moved to the right in FIG. 3(*a*). The key can be thus inserted into the keyhole even if the shutter plate 4 is arcuately deformed.

In this embodiment, the recess 8 is formed into the curved shape as shown in FIG. 1. However, the shape of the recess 8 is not limited thereto. For example, the recess 8 may be formed into a U shaped-groove or a V-shaped groove.

The present invention having the above configuration exhibits the following advantages. According to the present invention, as described above, the protector block includes the right and left receiving planes for receiving both ends of a bottom surface portion of the shutter plate; and a recess formed between the right and left receiving planes in such a manner as to be curved in the direction away from the shutter plate. Accordingly, even if the shutter plate is somewhat deformed in the axial direction of the keyhole, the deformed portion of the shutter plate interferes to a lesser extent with the recess. As a result, even if the shutter plate is somewhat deformed, it is possible to easily insert the key into the keyhole and to easily release a handle lock and start an engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A keyhole-shutter structure of a type in which a shutter plate biased to block the entrance of a keyhole is slid in a direction substantially perpendicular to the axial line of the keyhole by the leading end of a key for allowing insertion of the key in the keyhole, said structure comprising:

a protector block for mounting said shutter plate therein, wherein said protector block comprises:

right and left receiving planes for receiving both ends of a bottom surface portion of said shutter plate; and a recess formed between said right and left receiving planes, said recess being curved in the direction away from said shutter plate and including a linear edge intersecting each receiving plane, and a deepest portion at substantially a midpoint of the recess to form a space between the bottom surface portion of the shutter plate and the recess adapted to receive a deformed portion of the shutter plate.

2. The keyhole-shutter structure according to claim 1, wherein said shutter plate includes a notch for engagement with a key when actuating said shutter plate to gain entrance into said keyhole.

3. The keyhole-shutter structure according to claim 1, wherein said shutter plate has a bending rigidity to permit limited bending of said shutter plate when engaged by a key.

4. The keyhole-shutter structure according to claim 1, and further including a cap positioned to cover said protector block and said shutter plate, said cap including locking claws for securing said cap to said protector block.

5. The keyhole-shutter structure according to claim 1, wherein said shutter plate includes end portions projecting therefrom for engagement with said right and left receiving planes.

6. The keyhole-shutter structure according to claim 1, wherein said protector block includes a housing portion formed in an upper surface thereof for receiving said shutter plate and a spring member for biasing said shutter plate to a closed position for blocking access to said keyhole.

7. The keyhole-shutter structure according to claim 3, wherein said recess permits said shutter plate to be deflected into said recess when engaged by a key.

8. A keyhole-shutter structure comprising:

a protector block having a keyhole disposed therein;

a shutter plate for blocking the entrance of the keyhole, said shutter plate being biased to slide in a direction substantially perpendicular to the axial line of the keyhole for allowing insertion of a key in the keyhole, said shutter plate including a first end, a second end and a bottom surface;

right and left receiving planes being provided within said protector block for receiving said first end and said second end of said shutter plate; and a recess formed between said right and left receiving planes, said recess being curved in the direction away from said shutter plate and including a linear edge intersecting each receiving plane, and a deepest portion at substantially a midpoint of the recess to form a space between the bottom surface portion of the shutter plate and the recess adapted to receive a deformed portion of the shutter plate.

9. The keyhole-shutter structure according to claim 8, wherein said shutter plate includes a notch for engagement with a key when actuating said shutter plate to gain entrance into said keyhole.

10. The keyhole-shutter structure according to claim 8, wherein said shutter plate has a bending rigidity to permit limited bending of said shutter plate when engaged by a key.

11. The keyhole-shutter structure according to claim 8, and further including a cap positioned to cover said protector block and said shutter plate, said cap including locking claws for securing said cap to said protector block.

12. The keyhole-shutter structure according to claim 8, wherein said shutter plate includes end portions projecting therefrom for engagement with said right and left receiving planes.

13. The keyhole-shutter structure according to claim 8, wherein said protector block includes a housing portion formed in an upper surface thereof for receiving said shutter plate and a spring member for biasing said shutter plate to a closed position for blocking access to said keyhole.

14. The keyhole-shutter structure according to claim 10, wherein said recess permits said shutter plate to be deflected into said recess when engaged by a key.

* * * * *